US005813671A

United States Patent [19]

Barratt

[11] Patent Number: 5,813,671

[45] Date of Patent: Sep. 29, 1998

[54] GAME APPARATUS AND METHOD OF PLAY

[76] Inventor: Patricia G. Barratt, 17 Yeager Dr., Lawrenceville, N.J. 08648

[21] Appl. No.: 900,443

[22] Filed: Jul. 25, 1997

[51] Int. Cl.[6] ..... A63F 3/04

[52] U.S. Cl. ..... 273/251; 273/430

[58] Field of Search ..... 273/251, 252, 273/254, 246, 249, 430

[56] References Cited

U.S. PATENT DOCUMENTS

| | | | |
|---|---|---|---|
| 3,658,337 | 4/1972 | Peters | 273/254 |
| 3,883,142 | 5/1975 | Spohn | 273/251 |
| 4,052,072 | 10/1977 | Beal | 273/254 |
| 4,093,235 | 6/1978 | Barry | 273/254 |
| 4,124,214 | 11/1978 | Pavis | 273/249 |
| 4,784,394 | 11/1988 | Sumin | 273/251 |
| 4,834,389 | 5/1989 | Coffman et al. | 273/252 |
| 5,480,011 | 1/1996 | Jarvis | 273/478 |

FOREIGN PATENT DOCUMENTS

| | | | |
|---|---|---|---|
| 889725 | 2/1962 | United Kingdom | 273/246 |
| WO8103622 | 12/1981 | WIPO | 273/251 |

*Primary Examiner*—Benjamin H. Layno
*Attorney, Agent, or Firm*—LaMorte & Associates

[57] ABSTRACT

A game apparatus and an associated method of play. The game includes a map showing a geographical location. At least one game path is positioned over the map. The game path includes a plurality of separate playing spaces arranged in different zones along the game path. Each player is provided with a game piece that can be advanced along the game path. A plurality of sets of activity cards are provided, wherein each set of activity cards corresponds to one of the different zones along the game path. The activity cards describe a vacation activity that can be performed in the geographical region represented by that zone on the map. The activity of each activity card is assigned a predetermined point value. Trivia cards are also provided. When a player correctly answers a question from a trivia card, point values are again awarded. Depending upon how far a player moves during a turn at play, that player will either take an activity card, answer a trivia question, gain play money or lose play money by way of lodging and meals, bonuses and hazards. Activity cards and trivia questions provide players with points. Furthermore, points can be purchased during the game with play money. The player with the most accumulated points at the end of the game wins.

19 Claims, 5 Drawing Sheets

GAME APPARATUS AND METHOD OF PLAY

BACKGROUND OF THE INVENTION

1. Field of the Invention

The present invention is a game apparatus and an associated method of play that is generally intended to educate the game's players about the geography, natural attractions and manmade attractions of different regions of the world.

2. Prior Art Description

It is well known that people learn more efficiently if a learning experience is enjoyable and enables the person being taught to actively participate in the learning process. It is for this reason that educators have often created games that embody the subject that is to be taught. By having people play such an educational game, target information can be taught to the players in a fun, entertaining and interactive manner. The prior art record is replete with different games that are intended to teach players many different subjects.

In the field of geography, there exists many different games that are designed to teach the players about the world's geography or the geography of a specific region of the world. Such games are exemplified by U.S. Pat. No. 4,052,072 to Beal, entitled EDUCATIONAL WORLD MAP GAME and U.S. Pat. No. 2,658,337 to Peters, entitled BOARD GAME APPARATUS.

One common reason for people to become interested with the geography of a particular area of the world is when a trip to that area of the world is planned. For instance, if a person were travelling to a foreign country for the first time, that person may like to familiarize himself/herself with the cities and roads of that country as well as the locations of natural and manmade attractions within that country. Games of such a nature are often created by the tourist industries of different countries, states and other geo-political regions of the world in order to promote tourism. Such games are exemplified by U.S. Pat. No. 4,093,235 to Barry, entitled TOURIST GAME and U.S. Pat. No. 4,784,394 to Sumin, entitled TOURIST GAME APPARATUS.

Although many geography based games show the location of different manmade and natural attractions, such games do not always help in planning a vacation to see those attractions. Planning a vacation takes much more preparation than just determining where to go and what to see. In planning a vacation, a person must also determine how much different activities will cost, how long it takes to do different activities and how to select different activities within the time constraints of a vacation to maximize fun.

A need therefore exists in the art for a game that not only teaches geography of a particular region but also assists in helping a person plan a vacation to that region of the world. This need is met by the present invention as described and claimed below.

SUMMARY OF THE INVENTION

The present invention is a game and an associated method of play that educates the players about a particular geographical location and helps people plan a vacation to that particular geographical location. The game includes a map showing a geographical location. At least one game path is positioned over the map. The game path includes a plurality of separate playing spaces arranged in different zones along the game path. Each player is provided with a game piece that can be advanced along the game path. A plurality of sets of activity cards are provided, wherein each set of activity cards corresponds to one of the different zones along the game path. The activity cards describe a vacation activity that can be performed in the geographical region represented by that zone on the map. The activity described on each activity card is assigned a predetermined point value. Trivia cards are also provided. When a player correctly answers a question from a trivia card, point values are again awarded. Depending upon how far a player moves during a turn at play, that player will either take an activity card, answer a trivia question, gain play money or lose play money by way of lodging and meals, bonuses and hazards. Activity cards and trivia questions provide players with points. Furthermore, points can be purchased during the game with play money. The player with the most accumulated points at the end of the game wins.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention is a game and method of play that educates the players about various natural and manmade attractions associated with a particular region of the world in a manner that takes into account the cost factors and fun factors associated with visiting those different attractions. Although the preferred embodiment described below utilizes the format a board game depicting the north west corner of the United States of America, it will be understood that the game and the method of play can be adapted to other formats, such as that of a computer game. Furthermore, the theme of the game can be changed to any other region of the world and may include any country, state, continent or any region thereof. The illustrations provided therefore represent only one exemplary embodiment of how the present invention can be practiced.

Figure 1:
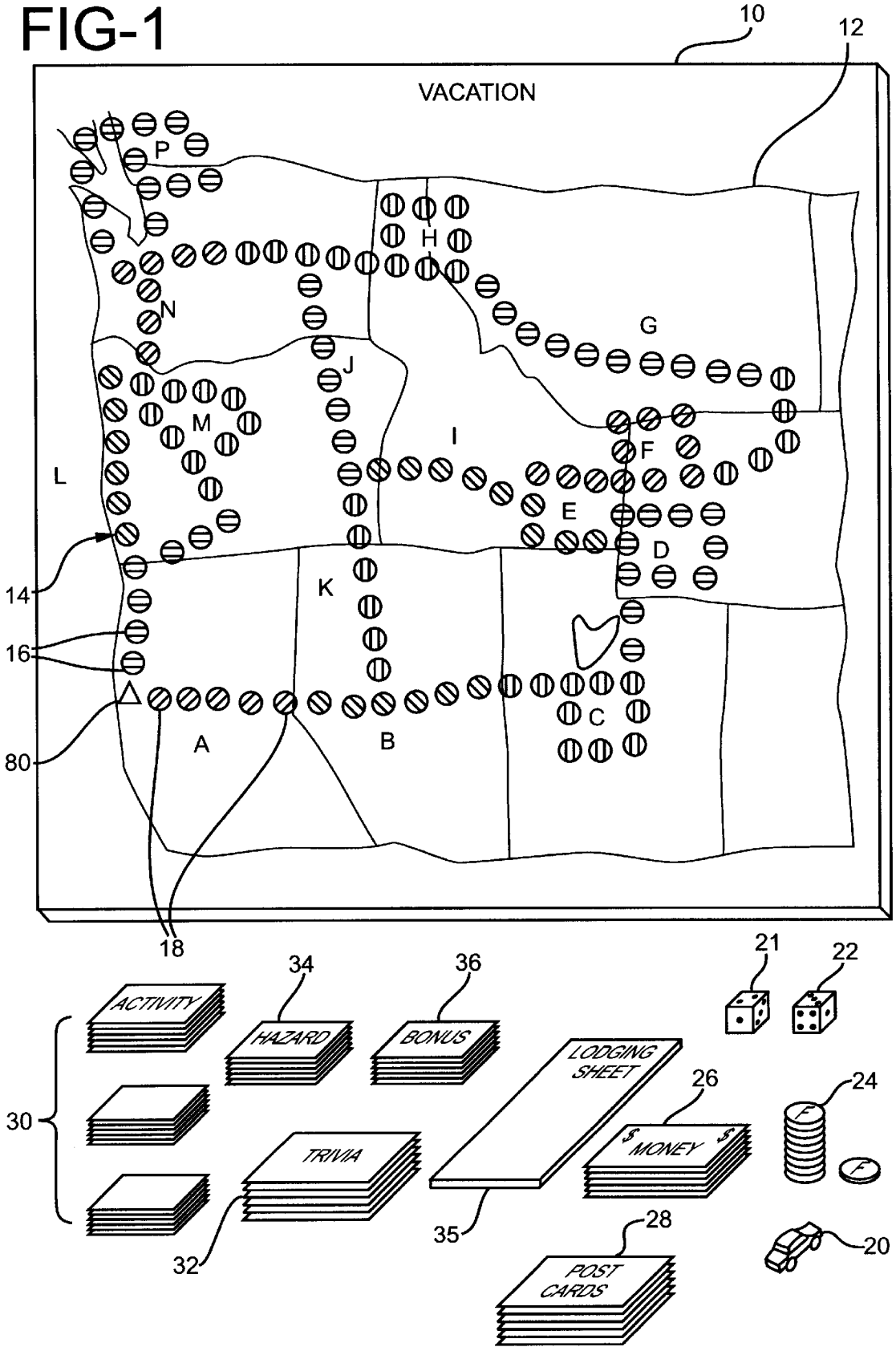
FIG. 1 is a top view of one preferred embodiment of a game board assembly in accordance with the present invention.

Referring now to FIG. 1, an exemplary embodiment of a game board 10 is shown. The game board 10 contains a map indicia 12 representing the north western corner of the United States of America. This section of the United States is often referred to as "The Great North West". The map indicia 12 shows the outlines of the various states located in this region as well as the major geographical features, such as the great Salt Lake, the Rocky Mountains and the like. A game path 14 is printed across the map indicia. The game path 14 is comprised of individual playing spaces 16. As will be later explained, some of the playing spaces 16 contain instruction icons while others are blank.

The game path 14 is divided into a plurality of different zones 18, wherein each of the playing spaces 16 in a particular zone are identified with a common color scheme. Each zone of playing spaces is also identified on the board with a letter (shown), word, phrase, number or other icon. For example in the shown embodiment, the letter "C" depicts the Salt Lake City zone of the game board, while the letter "D" depicts the Bear Lake zone.

In addition to the game board 10, the physical structure of the game also preferably includes game pieces 20, dice 21, 22, tokens 24, play money 26, postcards 28, activity cards 30, trivia question cards 32, hazard cards 34, lodging information sheets 35 and bonus cards 36. The use of these game elements will later be explained during the description of the method of play.

Figure 2:
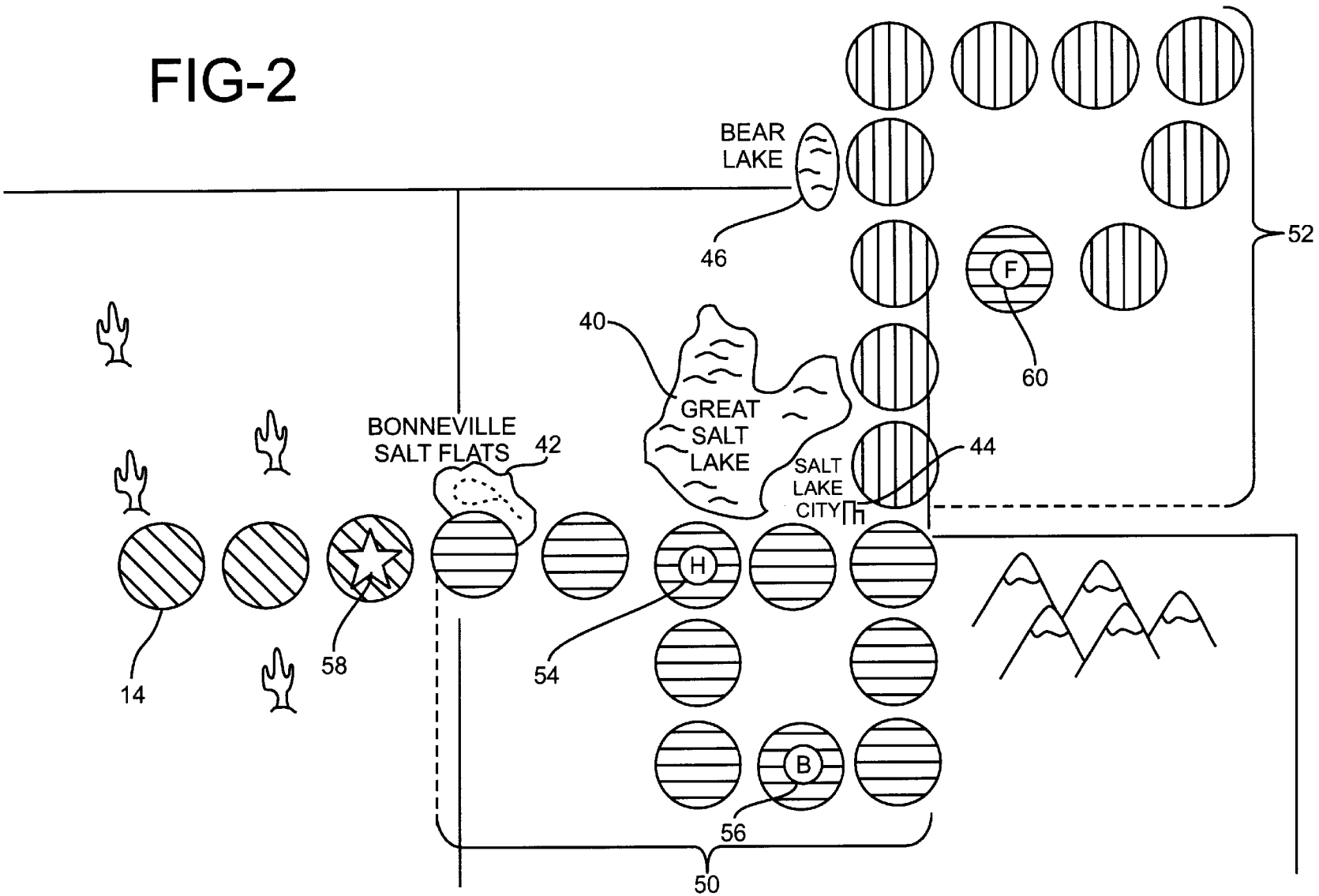
FIG. 2 is an enlarged view of a segment of FIG. 1.

Referring to FIG. 2, it can be seen that the game board shows many of the different natural and manmade attractions that are present in the region illustrated on the game board. In the shown example, it can be seen that near the great Salt Lake 40 there is also shown the Bonneville Salt Flats 42, Salt Lake City 44 and Bear Lake 46. From FIG. 2, it can be seen that the Bonneville Salt Flats 42 and Salt Lake city 44 are contained within the Salt Lake City zone 50 of the game path 14, while Bear Lake 46 is contained in the different Bear Lake zone 52 of the game path 14.

In addition to the illustration of natural and manmade attractions, some of the playing spaces in each zone of the game path 14 display instructional icons. The instructional icons include "HAZARD" icons 54, "BONUS" icons 56, "ATM MACHINE" icons 58 and "PURCHASE FUN POINTS" icons 60. The various icons can be any unique shape, figure, word, letter, phrase or number. However, in the exemplary embodiment illustrated the hazard icon 54 is represented by a red circle. The bonus icon 56 is represented by a green circle. The ATM machine icon 58 is represented by a star. Lastly, the purchase fun point icon 60 is represented by an orange circle.

Figure 4:
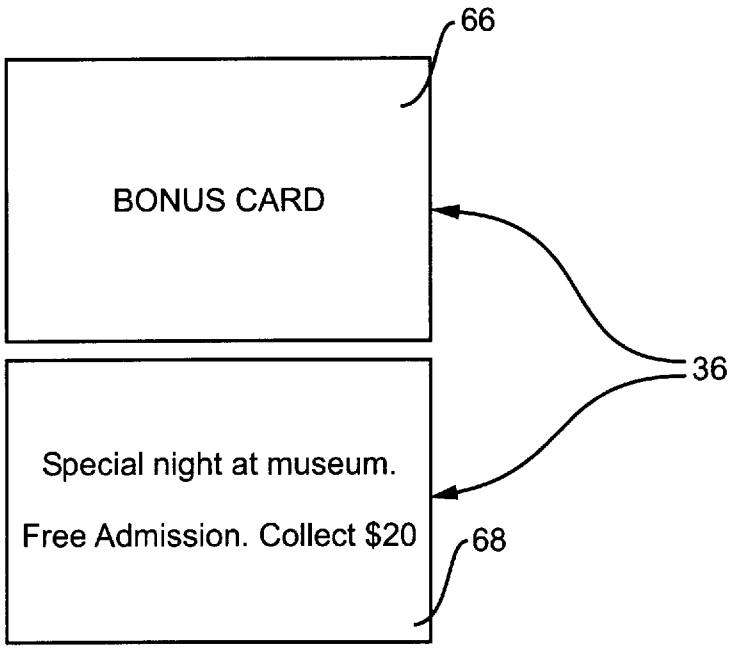
FIG. 4 shows a top and bottom view of an exemplary bonus card in accordance with the present invention.
Figure 3:
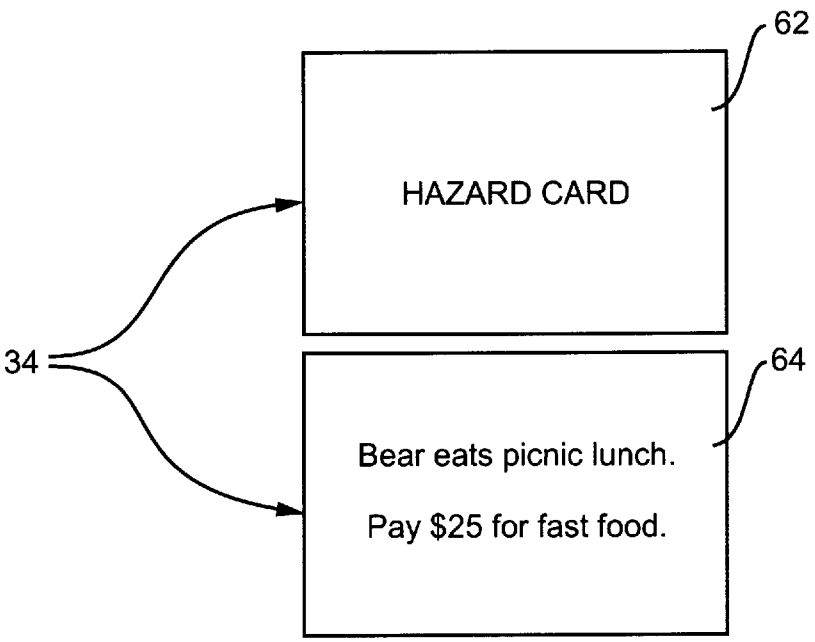
FIG. 3 shows a top and bottom view of an exemplary hazard card in accordance with the present invention.

As will be later explained, when a player lands on a hazard icon 54 or a bonus icon 56 that player selects either a hazard card or a bonus card, respectively. Referring to FIG. 3, the top and bottom of an exemplary hazard card 34 are shown. The top 62 of the hazard card 34 identifies the card as being a hazard card. The bottom 64 of the hazard card 34 describes some unexpected expense that may be incurred during a vacation to the region set forth on the map of the game board. Conversely, referring to FIG. 4, the top and bottom of an exemplary bonus card 36 are shown. The top 66 of the bonus card 36 identifies the card as being a bonus card. The bottom 68 of the bonus card 36 describes some unexpected event that results in a financial plus to the player.

Figure 5:
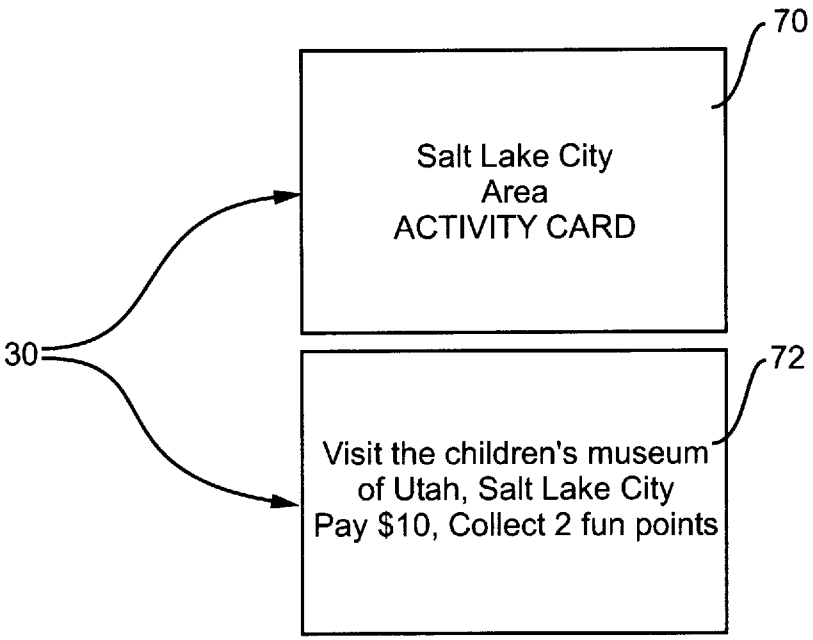
FIG. 5 shows a top and bottom view of an exemplary activity card in accordance with the present invention.

In addition to the hazard cards 34 and bonus cards 36, the game also includes activity cards 30, trivia cards 32 and a lodging information sheet 35 (FIG. 1). Referring to FIG. 5, the top and bottom of an exemplary activity card 30 are shown. The top 70 of the activity card identifies the card as being an activity card associated with a particular zone of the game board. For example, if the game board containing a game path with ten different zones of playing spaces, there would be ten sets of activity cards, wherein each set of activity cards corresponds to one of the zones on the game board. In the shown embodiment, a Salt Lake City activity card is shown. Such a card is used when a player enters the Salt Lake City zone of playing spaces such as those shown in the center of FIG. 2. The bottom 72 of each activity card describes some event that a person can do when in that zone. For example, the activity card of FIG. 5 states the activity of visiting the Children's Museum of Utah in Salt Lake City. This activity can only be done when in the Salt lake City zone, as such the activity is stated only in the activity cards for the Salt Lake City zone. Each activity card also sets forth a fun point value for that activity.

Figure 6:
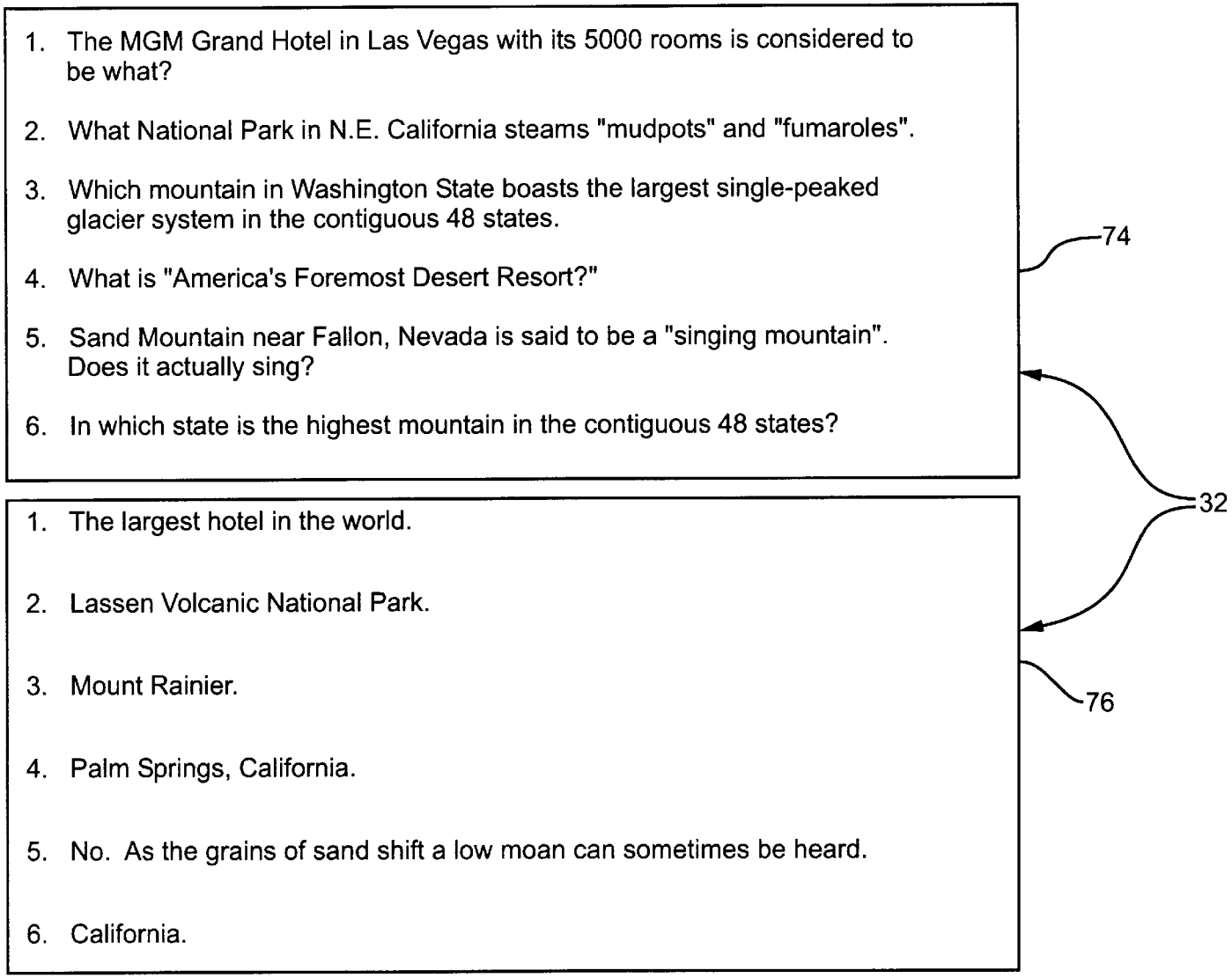
FIG. 6 shows a top and bottom of an exemplary trivia card in accordance with the present invention.

Referring to FIG. 6, an exemplary trivia card 32 is shown. The top 74 of the card lists a plurality of general trivia questions concerning the overall region of the world depicted on the board game. The bottom 76 of the card lists the corresponding answers to those questions.

A lodging information sheet 3 ( FIG. 1) is provided for each of the different zones of playing spaces indicated on the board game. Each lodging information sheet lists a plurality of lodging choices for a zone and the cost associated with staying at that lodging choice. The lodging choices listed on each lodging information sheet include a mixture of expensive, moderate and cheap lodging cites. The lodging sites listed preferably do exist in the real world and the cost listed for those lodging sites is preferably accurate. An exemplary lodging listing on the lodging information sheet is recreated below.

PERCY PARK INN, VICTORIAN HOTEL- 3 story, a suite with kitchen, no A/C, T.V., complimentary continental breakfast and afternoon tea with cookies.
MEALS - Breakfast: included
Lunch: Picnic to take to wine country
Dinner: Enjoy pasta at Italian cafe.
$180.00 lodging
$150.00 meals $330.00 Total.

In a preferred embodiment, there will be six lodging choices listed on each of the lodging information sheets. The number six is selected to correspond to the sides of a standard die. In this manner a player can roll a die and randomly select from the six lodging choices. Other pluralities of lodging choices can be used if alternate random selection mechanisms are utilized.

METHOD OF PLAY

Having described the various physical components of the game, the method of play can now be described by referring to FIG. 1. To begin the game, each player is given a predetermined amount of play money 26 and a game piece 20. Each of the players place their game piece 20 in the start position 80 on the game board. The first player rolls one of the dice 21 to move his/her game pieces along the playing path. In the preferred embodiment, the die 21 that is rolled only contains the numbers "1", "2", and "3". In a shortened version of the game a standard six choice die can be used. If the player rolls a one, that player moves his/her game piece 20 one place forward on the game 14 path. If more than one playing path intersects the starting position, the player can begin along any path he/she desires. If a one is rolled on the die 21, the player must answer a trivia question from the trivia cards 32. The question on the card 32 to be asked and answered can be determined by again rolling one of the dice 22. If the player answers the question correctly, then that player gets one fun point and gets to repeat his/her turn. If the player gets the question wrong, it is the next players turn to play. Fun points are awarded to the player as tokens 24.

If a player rolls a two "2" on the die 21, that player moves his/her game piece 20 two spaces forward on the board and takes an activity card 30. The activity card 30 to be taken must correspond to the zone 18 in which the player's game piece 20 is located. For example, if a player moves two spaces into the Salt Lake City zone, such as shown in FIG. 2, then that player will take a Salt Lake City activity card such as that shown in FIG. 5. The player reads the activity card 30, pays the fee (if any) indicated on the activity card 30 and receives fun point tokens as instructed by the activity card 30. The player's turn is then over and the player keeps the activity card 30 until the end of the game.

If a player rolls a three "3" with the die, then that player moves his/her game piece 20 forward on the game board 10 three spaces. That player must now stop for lodging and meals. The player takes the lodging information sheet 35 for the zone in which that player's game piece 20 has landed. Using dice or another random selection means, one of the choices on that lodging information sheet 35 is randomly selected. The player then must pay the price indicated on the lodging information sheet 35 and that player's turn is over.

The object of the game is for a player to move his/her game piece 20 across the finish with the most fun points as possible, while not being in debt. If a player spends all of his/her money 26 prior to crossing the finish, then that player is out of the game. Referring to FIG. 2, it can be seen that some of the playing spaces contain fun point purchase icons 60. If a player lands on a playing space that contains a fun point purchase icon 60, that player can purchase fun points directly in exchange for a predetermined amount of play money 26.

In FIG. 2, a playing space with an ATM icon 58 is also shown. If a player is running low on money, that player may elect to borrow additional money when they land on a space with an ATM icon 58. When a player lands on a playing space with an ATM icon 58, that player can withdraw a predetermined amount of play money 26 for use in the game. The amount of money withdrawn plus a predetermined interest amount must be paid back before the end of the game. The player can pay back his/her debt either with the play money 26 or with fun point tokens 24. Each fun point token is given a predetermined exchange value. When the player withdraws money, that player may optionally supply the bank with an IOU voucher (not shown) so that the amount withdrawn can be recalled at the end of the game.

The player that crosses the finish first does not necessarily win the game. There are many different paths that players can take on the game board. Accordingly, it will take some players longer to reach the finish than it will others. However, to provide an incentive to finish early, each player that crosses the finish receives a predetermined number of fun points plus another predetermined number of fun points for each of the players still left on the board.

Optionally, the game may include postcards 28 (FIG. 1) from the various zones depicted on the game board. The purpose of the postcards is to help the players visualize some of the attractions that are contained within that zone. In one method of play, a player would receive a postcard 28 each time that player entered a different zone of playing spaces on the game board.

By playing the game, the players learn about the geography of the area depicted on the game. The players learn about the different zones within that geographical area and the activities that are available within each zone. Players learn about lodging and meals and get a feel for how much a real vacation to that region of the world would cost and how much fun can be expected during that vacation. The players will also learn basic trivia about the region expressed on the game so that any visit to that region would seem more interesting. The game can also be used by people who have completed their vacations and would like an opportunity to remember their vacation and invoke memories from that vacation.

It will be understood that the embodiments of the present invention described and illustrated herein are merely exemplary and a person skilled in the art can make many variations to the embodiment shown without departing from the scope of the present invention. For example, the described embodiment uses a three option die and a six option die as the random selection devices of the game. Other random selection devices can of course be substituted, such as different dice, chance wheels, and the like. Furthermore, the size, shape, configuration and number of playing spaces in the game board can be changed to fit any map of a geographical region. All such variations, modifications and alternate embodiments are intended to be included within the scope of the present invention as defined by the appended claims.

What is claimed is:

1. A game apparatus having a vacation motif for play by a plurality of players, comprising:

a map showing a geographical location;

at least one game path extending between a beginning point and an end point on said map, wherein said at least game path includes a plurality of separate playing spaces arranged in different zones along said at least one game path;

a game piece for each of the players that is capable of being advanced along said playing spaces on said at least one game path;

a plurality of sets of activity cards, wherein each set of activity cards corresponds to one of said different zones along said at least one game path and describes a vacation activity that be performed in the geographical region represented by that zone on said map;

a plurality of trivia cards, each trivia card containing at least one trivia question and answer regarding the geographical region shown on said map;

a plurality of lodging sheets, each lodging sheet containing lodging sites and lodging costs for each zone along said at least one game path; and a random selection device having a plurality of random selection indicia, said random selection device randomly selecting between at least three options wherein a slaver selects from said sets of activity cards, said trivia cards and said lodging sheets depending upon the random selection indicia produced by said random selection device.

2. The game apparatus according to claim 1, wherein said map and said at least one game path are indicia on a game board.

3. The game apparatus according to claim 1, wherein each of said activity cards includes a stated fee for the described vacation activity and a stated fun value for the described vacation activity.

4. The game apparatus according to claim 1, further including a plurality of hazard cards wherein each of said hazard cards states a hazard that can occur during a vacation to the region represented.

5. The game apparatus according to claim 4, wherein each of said hazard cards includes a stated penalty for the described hazard.

6. The game apparatus according to claim 4, wherein said at least one game path includes playing spaces with a hazard indicia.

7. The game apparatus according to claim 1, further including a plurality of bonus cards wherein each of said bonus cards states a bonus of a stated monetary value.

8. The game apparatus according to claim 7, wherein said at least one game path includes playing spaces with a bonus indicia.

9. A method of playing a game, comprising the steps of:

providing a game path along a representation of a geographical area, wherein said game path contains different zones that correspond to different regions of the represented geographical area;

using a random selection device to determine how far along said game path a player is to advance a game piece;

selecting a card if a player advances a first predetermined distance during a turn at play, wherein said card indicates a point value; and attempting to answer a question if a player advances a second predetermined distance during a turn at play, wherein a the player obtains a point value for a correct answer;

wherein the player with the highest point value at the end of the game wins.

10. The method according to claim 9, wherein said step of selecting a card includes selecting a card that is specific to the zone in which the player's game piece lay, said card describing a vacation activity that can be performed in that zone.

11. The method according to claim 9, wherein said question is a trivia question concerning the geographical region represented on said map.

12. The method according to claim 9, wherein said question is a trivia question concerning an attraction contained within said geographical region represented on said map.

13. The method according to claim 9, further including the step of providing each of said players with a predetermined amount of play money.

14. The method according to claim 13, further including the step of selectively exchanging play money for a point value when a player lands upon at least one first predetermined space in said game path.

15. The method according to claim 13, further including the step of obtaining additional play money when a player lands upon at least one second predetermined space in said game path.

16. The method according to claim 13, further including the step of losing play money when a player lands upon at least one third predetermined space in said game path.

17. The method according to claim 13, further including the step of losing play money if a player advances a third predetermined distance during a turn at play.

18. The method according to claim 17, further including the step of randomly selecting a lodging site from a list of lodging sites when a player advances said third predetermined distance during a turn at play, wherein the player loses an amount of play money corresponding to the lodging costs associated with each lodging site on said list.

19. The method according to claim 13, further including the step of providing a player with the opportunity to borrow play money when a player lands upon at least one fourth predetermined space in said game path.

* * * * *